US011807447B2

(12) United States Patent
Fradeani et al.

(10) Patent No.: US 11,807,447 B2
(45) Date of Patent: Nov. 7, 2023

(54) RIGID PACK FOR SMOKING ARTICLES PROVIDED WITH A HINGED LID

(71) Applicant: G.D SOCIETA' PER AZIONI, Bologna (IT)

(72) Inventors: Claudia Fradeani, Bologna (IT); Lorena D'Alfonso, Bologna (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 112 days.

(21) Appl. No.: 17/430,050

(22) PCT Filed: Feb. 11, 2020

(86) PCT No.: PCT/IB2020/051084
§ 371 (c)(1),
(2) Date: Aug. 11, 2021

(87) PCT Pub. No.: WO2020/165764
PCT Pub. Date: Aug. 20, 2020

(65) Prior Publication Data

US 2022/0144535 A1 May 12, 2022

(30) Foreign Application Priority Data

Feb. 12, 2019 (IT) ..... 102019000002001

(51) Int. Cl.
*B65D 85/10* (2006.01)
*B65D 50/06* (2006.01)

(52) U.S. Cl.
CPC ..... *B65D 85/1054* (2013.01); *B65D 50/06* (2013.01)

(58) Field of Classification Search
CPC .. B65D 50/06; B65D 85/1054; B65D 5/6688; B65D 85/1048; B65D 5/38; B65D 85/10564; A24F 15/00
(Continued)

(56) References Cited

U.S. PATENT DOCUMENTS 3,048,320 A * 8/1962 Hovland ..... B65D 5/6688 206/250
3,773,247 A * 11/1973 Mueller ..... B65D 5/6688 206/267

(Continued)

FOREIGN PATENT DOCUMENTS

CH 370699 A 7/1963
DE 2437765 A1 3/1975

(Continued)

OTHER PUBLICATIONS

International Search Report and Written Opinion for corresponding International Application No. PCT/IB2020/051084, dated May 13, 2020.

*Primary Examiner* — Chun Hoi Cheung
(74) *Attorney, Agent, or Firm* — MARSHALL, GERSTEIN & BORUN LLP

(57) ABSTRACT

A pack for smoking articles can include a group of smoking articles; an inner wrap, which houses the group of smoking articles; a rigid outer container which is cup-shaped, houses the inner wrap and has: an open upper end, a lower wall opposite the open upper end, a front wall and a rear wall opposite one another, and two side walls opposite one another; a lid, which is cup-shaped, is hinged to the outer container along a hinge so as to rotate, relative to the outer container, between an open position and a closed position, and has: an open lower end, an upper wall, a front wall and
(Continued)

a rear wall opposite one another, and two side walls opposite one another; and a locking system.

13 Claims, 17 Drawing Sheets

(58) Field of Classification Search
USPC ..... 206/242–276, 1.5; 229/125.125
See application file for complete search history.

(56) References Cited

U.S. PATENT DOCUMENTS

RE28,882 E * 6/1976 Mueller ..... B65D 85/1054 229/125.08
3,977,520 A * 8/1976 Grimm ..... B65D 85/1054 206/270
4,007,828 A * 2/1977 Mayled ..... B65D 11/12 220/8
4,049,117 A * 9/1977 Grimm ..... B65D 5/6688 206/270
7,992,708 B2 * 8/2011 Hein ..... B65D 85/1054 206/251
8,042,685 B2 * 10/2011 Bourgoin ..... B65D 85/1054 206/268
8,745,962 B2 * 6/2014 Squarzoni ..... B65D 85/1054 53/170
8,997,979 B2 * 4/2015 Ghini ..... B65D 5/38 206/267
9,198,465 B2 * 12/2015 Ghini ..... B65D 5/728
9,254,938 B2 * 2/2016 Iwata ..... B65D 85/1054
9,475,605 B2 * 10/2016 Everett ..... B65D 59/04
2005/0103654 A1 5/2005 Hennessy
2009/0152134 A1 * 6/2009 Katsis ..... B65D 5/38 206/96

FOREIGN PATENT DOCUMENTS

JP 2012-076811 A 4/2012
WO WO-2008/054305 A1 5/2008
WO WO-2016/138305 A1 9/2016

* cited by examiner

RIGID PACK FOR SMOKING ARTICLES PROVIDED WITH A HINGED LID

CROSS-REFERENCE TO RELATED APPLICATIONS

This patent application is a U.S. national phase of International Patent Application No. PCT/IB2020/051084 filed Feb. 11, 2020, which claims priority from Italian patent application no. 102019000002001 filed Feb. 12, 2019, the respective disclosures of which are each incorporated herein by reference in their entireties.

TECHNICAL FIELD

The present invention relates to a rigid pack for smoking articles provided with a hinged lid.

The present invention finds advantageous application to a pack of cigarettes, to which the following description will make explicit reference without thereby losing generality.

PRIOR ART

Rigid packs of cigarettes with hinged lids are currently the most popular packs of cigarettes on the market as they are simple to manufacture, are easy and practical to use, and offer effective protection to the cigarettes contained within.

A rigid pack of cigarettes with a hinged lid comprises a group of cigarettes wrapped in a wrapping sheet of metallized paper to define an inner wrap and a rigid container that houses the inner wrap; the container is cup-shaped, has an open upper end, and is provided with a lid, which is also cup-shaped and is hinged to the container along a hinge so as to rotate, relative to the container, between an open position and a closed position of the open end. A collar is normally provided, which is folded and connected to the inside of the container to partially protrude outwards from the open end and engage a corresponding inner surface of the lid when the lid is arranged in the closed position.

The opening of a rigid pack of cigarettes with a hinged lid is simple and intuitive even for a child and therefore a rigid pack of cigarettes with a hinged lid cannot be classified as "child-proof" or "child resistant", namely, able to prevent children from opening the same. Normally, a pack of cigarettes is classified as "child-proof" if its opening, i.e. the possibility to access the content, is precluded by mechanisms that an uninformed user would not be able to unlock. In other words, a pack of cigarettes is defined as "child-proof" when its opening (and therefore access to content) is not immediate and requires the application of particular force or torque in predetermined points, or sequences of non-intuitive movements for the effective unlocking of the opening of the pack of cigarettes.

Patent application JP2012076811A describes a sliding container in which an inner box and an outer box can firmly engage with one another and this engagement can be released by exerting a small force.

Patent application US2005103654 describes a rigid pack of cigarettes comprising a container which is provided with a hinged lid and houses a group of cigarettes and an outer sleeve which surrounds the container and can axially slide relative to the container itself.

DESCRIPTION OF THE INVENTION

The object of the present invention is to provide a rigid pack for smoking articles provided with a hinged lid that can be classified as "child-proof", namely, adapted to prevent children from opening the same, and at the same time, easy and inexpensive to implement.

According to the present invention, a rigid pack for smoking articles provided with a hinged lid, according to what is claimed in the attached claims, are provided.

The claims describe preferred embodiments of the present invention forming an integral part of the present description.

BRIEF DESCRIPTION OF THE DRAWINGS

The present invention will now be described with reference to the attached drawings, which illustrate some non-limiting examples of embodiments, wherein.

PREFERRED EMBODIMENTS OF THE INVENTION

Figure 2:
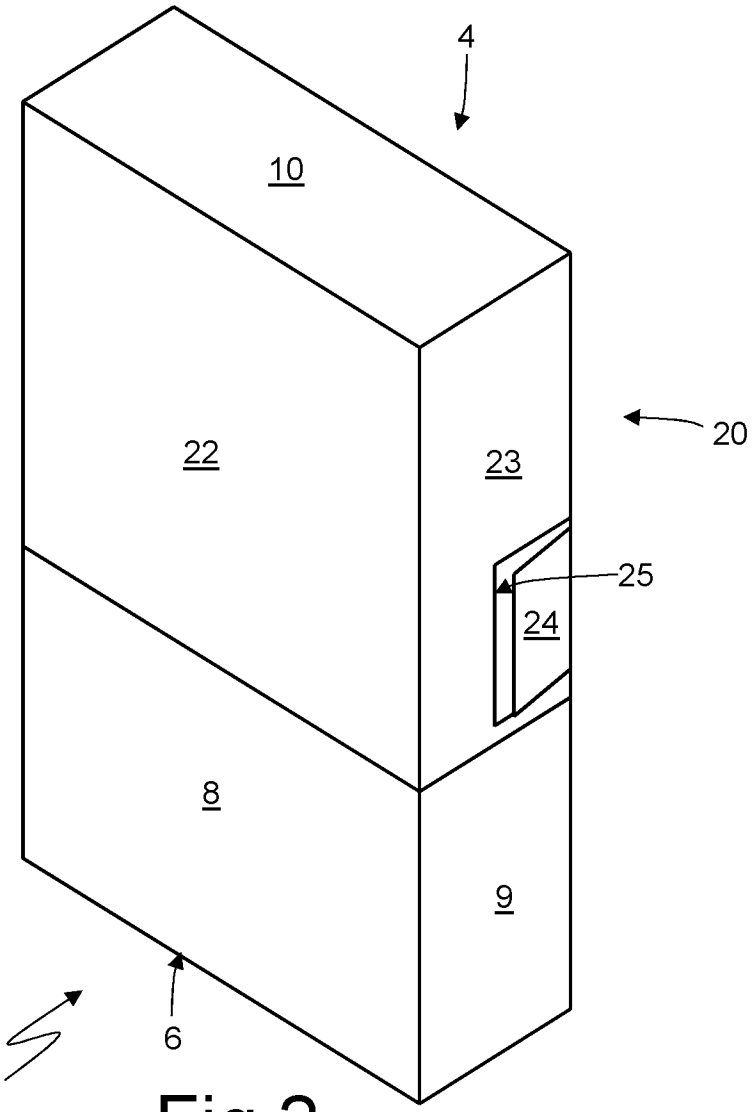
FIG. 2 is a rear perspective view of the pack of cigarettes of FIG. 1 in a closed configuration and with an activated locked opening of the lid.

In FIGS. 1-7 number 1 denotes as a whole a rigid pack of cigarettes.

The pack 1 of cigarettes comprises a rigid outer container 2 (i.e. made of cardboard or rigid paperboard) which is cup-shaped, has an open upper end 3 (shown in FIG. 7), and is provided with a lid 4. The lid 4 it is cup-shaped and is hinged to the outer container 2 along a hinge 5 (illustrated in FIG. 4) so as to rotate, relative to the outer container 2, between an open position (illustrated in FIG. 7) and a closed position (illustrated in FIGS. 1-5).

The outer container 2 has a substantially rectangular parallelepiped shape oriented according to a prevalently vertical development direction, is cup-shaped, and has the upper end 3 open, a lower wall 6 opposite the upper end 3 open, a front wall 7 and a rear wall 8 (in which the hinge 5 is arranged) parallel to and opposite one another, and two side walls 9 parallel to and opposite one another. Four longitudinal edges are defined between the front 7, rear 8 and side 9 walls of the outer container 2, while four transverse edges are defined between the walls 7, 8 and 9 and the lower wall 6 of the outer container 2.

The lid 4 has a substantially rectangular parallelepiped shape, is cup-shaped, and has an open lower end (facing the open upper end 3 of the outer container 2 when the lid 4 is in the closed position), an upper wall 10 (which is parallel to and opposite the lower wall 6 of the outer container 2 when the lid 4 is in the closed position), a front wall 11 (which is parallel to and aligned with the front wall 7 of the outer container 2 when the lid 4 is in the closed position), a rear wall 12 (which is parallel to and aligned with the rear wall 8 of the outer container 2 when the lid 4 is in the closed position and is hinged to the rear wall 8 of the outer container 2 along the hinge 5), and two side walls 13 parallel to and opposite one another (which are parallel to and aligned with, in particular coplanar and adjacent to, the side walls 9 of the outer container 2 when or lid 4 is in the closed position). Four longitudinal edges are defined between the front 11, rear 12 and side 13 walls of the lid 4, while four transverse edges are defined between the walls 11, 12 and 13 and the upper wall 10 of the lid 4. The longitudinal and transverse edges of the lid 4 are parallel to and aligned with the corresponding longitudinal and transverse edges of the outer container 2 when the lid 4 is in the closed position.

Figure 7:
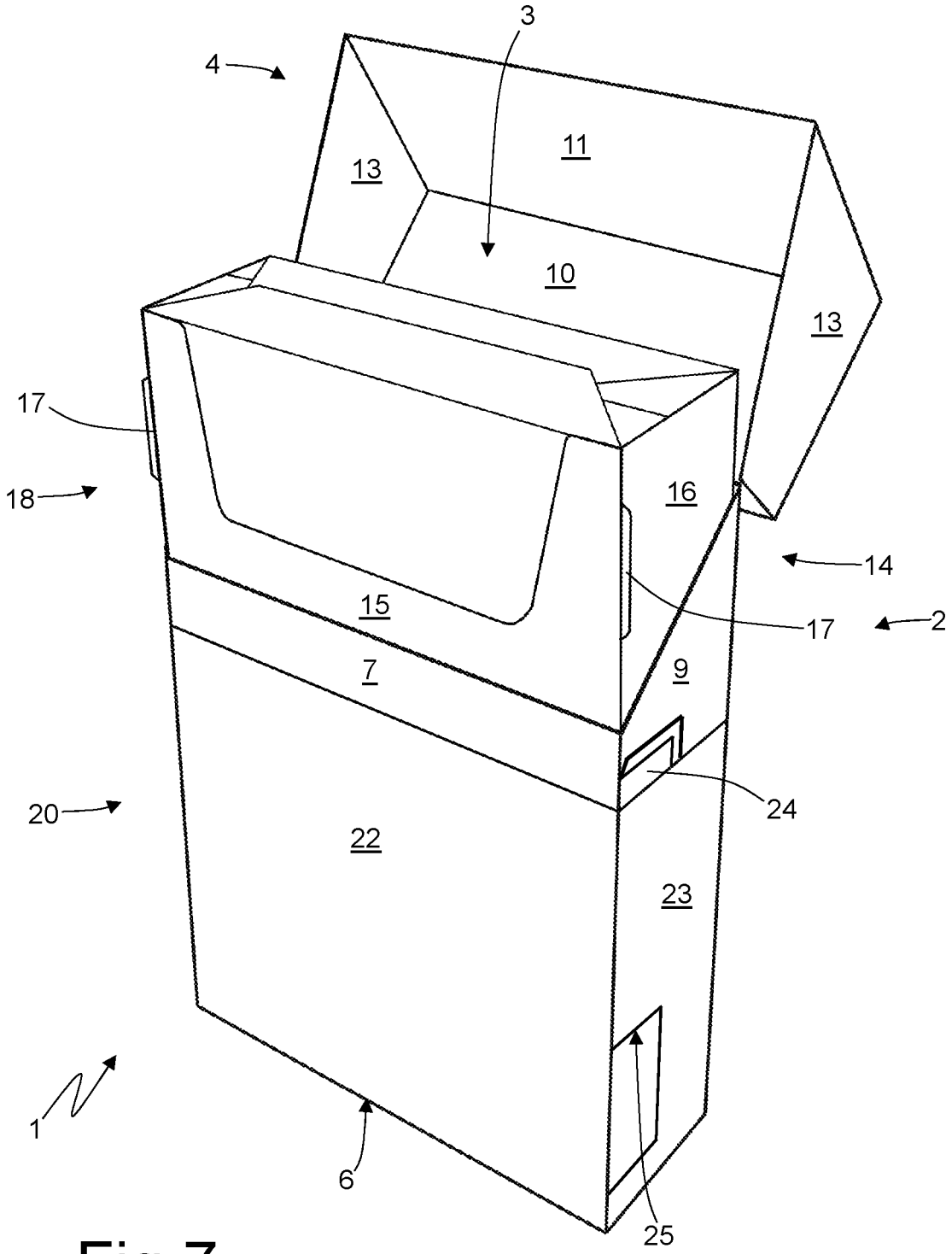
FIG. 7 is a front perspective view of the pack of cigarettes of FIG. 1 in an open configuration.
Figure 14:
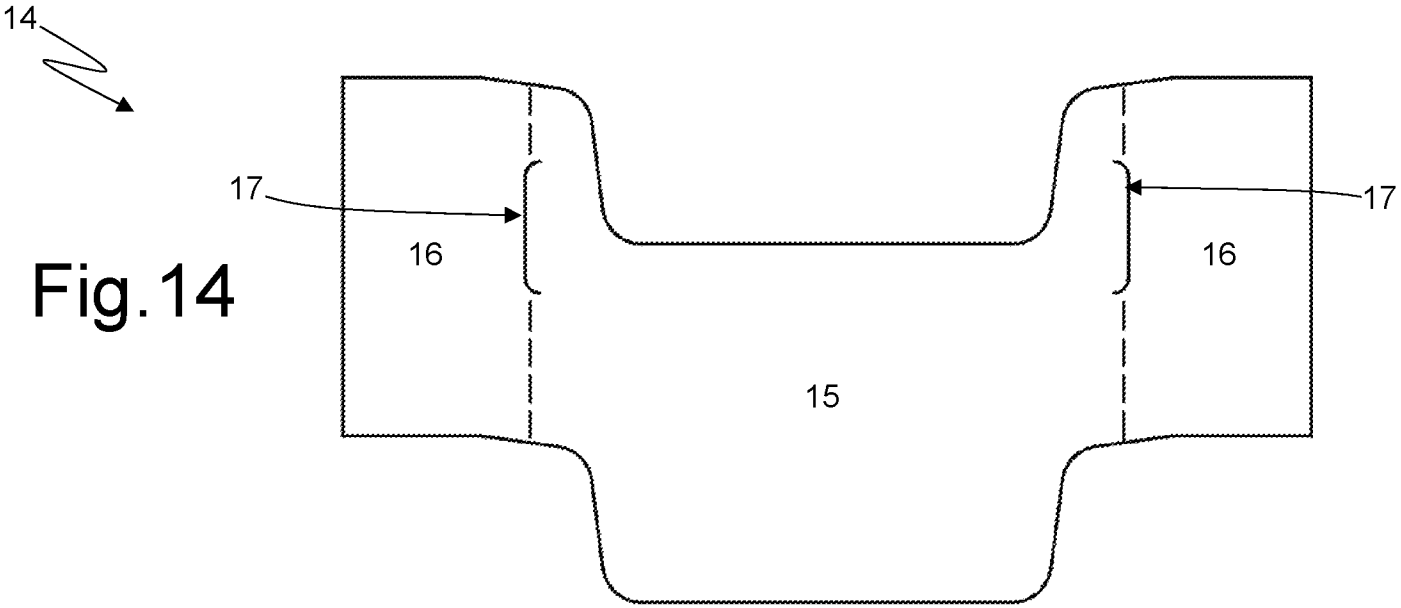
FIG. 14 is a plan view of an extended collar of the pack of cigarettes of FIG. 1.

As illustrated in FIGS. 7 and 14, the pack 1 of cigarettes comprises, furthermore, a rigid collar 14, which is connected (by gluing) folded in a "U" shape inside the outer container 2 to partially protrude outwards from the open upper end 3 of the outer container 2 and engage a corresponding inner surface of the lid 4 when the lid 4 is arranged in the closed position. The collar 14 comprises a front wall 15, which is connected to the front wall 7 of the container 2 and is arranged in contact with the front wall 11 of the lid 4 when the lid 4 is in the closed position, and two side walls 16, which are connected to the side walls 9 of the container 2 and are arranged in contact with the side walls 13 of the lid 4 when the lid 4 is in the closed position. According to the embodiment illustrated in the attached Figures, the front wall 15 of the collar 14 is provided with a pair of projections 17 which protrude laterally to engage the side walls 13 of the lid 4 with interference when the lid 4 is in the closed position so as to keep the lid 4 in the closed position. According to a different embodiment not illustrated, the front wall 15 of the collar 14 is devoid of the projections 17.

Figure 12:
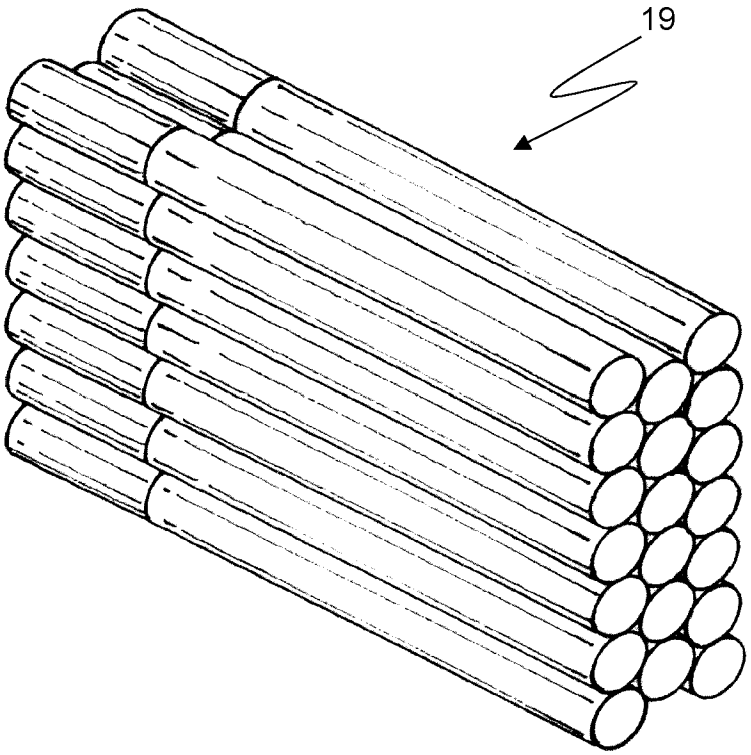
FIG. 12 is a perspective view of a group of cigarettes housed in the inner wrap of FIG. 11.
Figure 11:
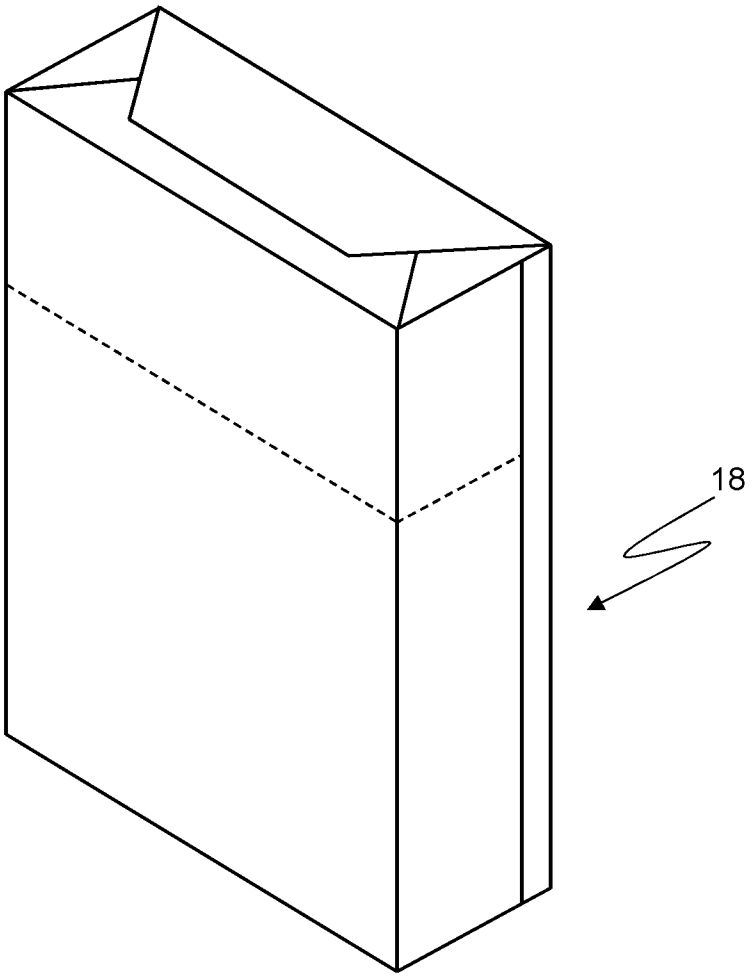
FIG. 11 is a perspective view of an inner wrap of the pack of cigarettes of FIG. 1.

As illustrated in FIGS. 7 and 11, the pack 1 of cigarettes comprises an inner wrap 18 which is arranged (housed) in the outer container 2 to partially protrude outwards from the open upper end 3 and encloses a group 19 of cigarettes (illustrated in FIG. 12). In the embodiment illustrated in the attached Figures, the inner wrap 18 is a traditional type (i.e. not sealed) and has a removable upper portion (the so-called "pull") which must be removed the first time the pack 1 of cigarettes is opened to access the cigarettes. According to an alternative embodiment, the inner wrap 18 is a sealed type and has an extraction opening engaged by a reusable closing label (i.e. provided with a re-stick glue); in this embodiment the collar 14 could also be absent (as replaced by a rigid reinforcement element arranged inside the inner wrap 18).

Figure 1:
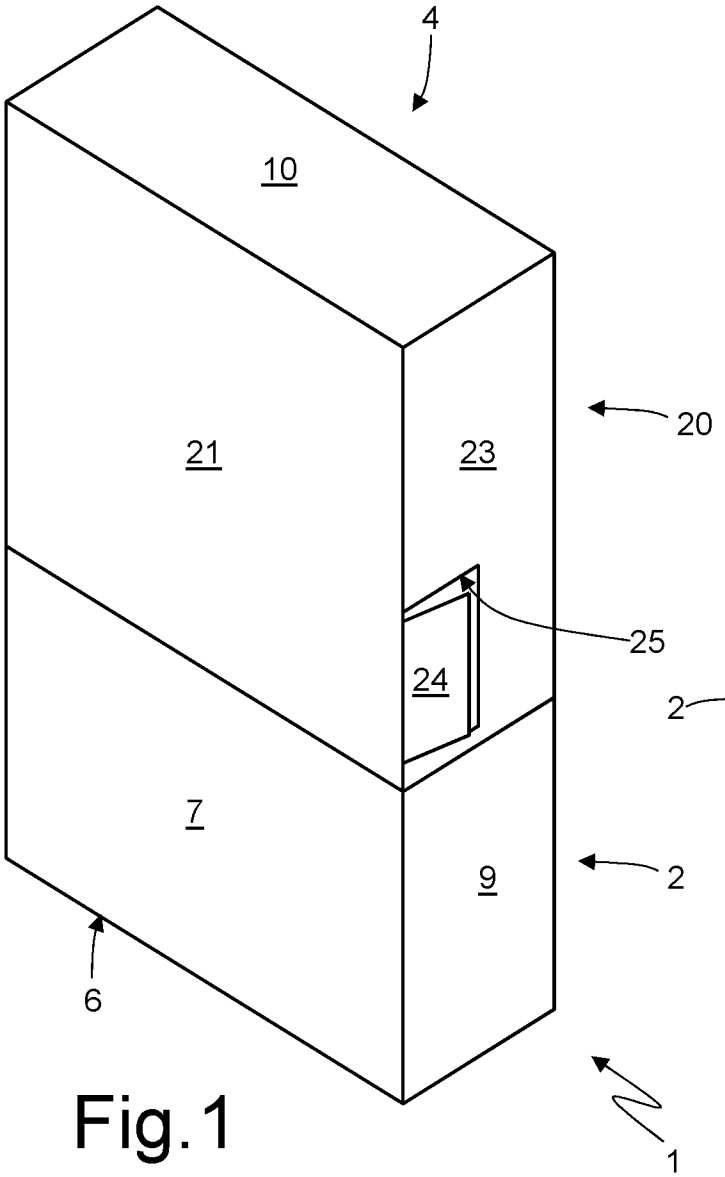
FIG. 1 is a front perspective view, in a closed configuration, and with an activated locked opening of the lid of a pack of cigarettes made according to the present invention.
Figure 4:
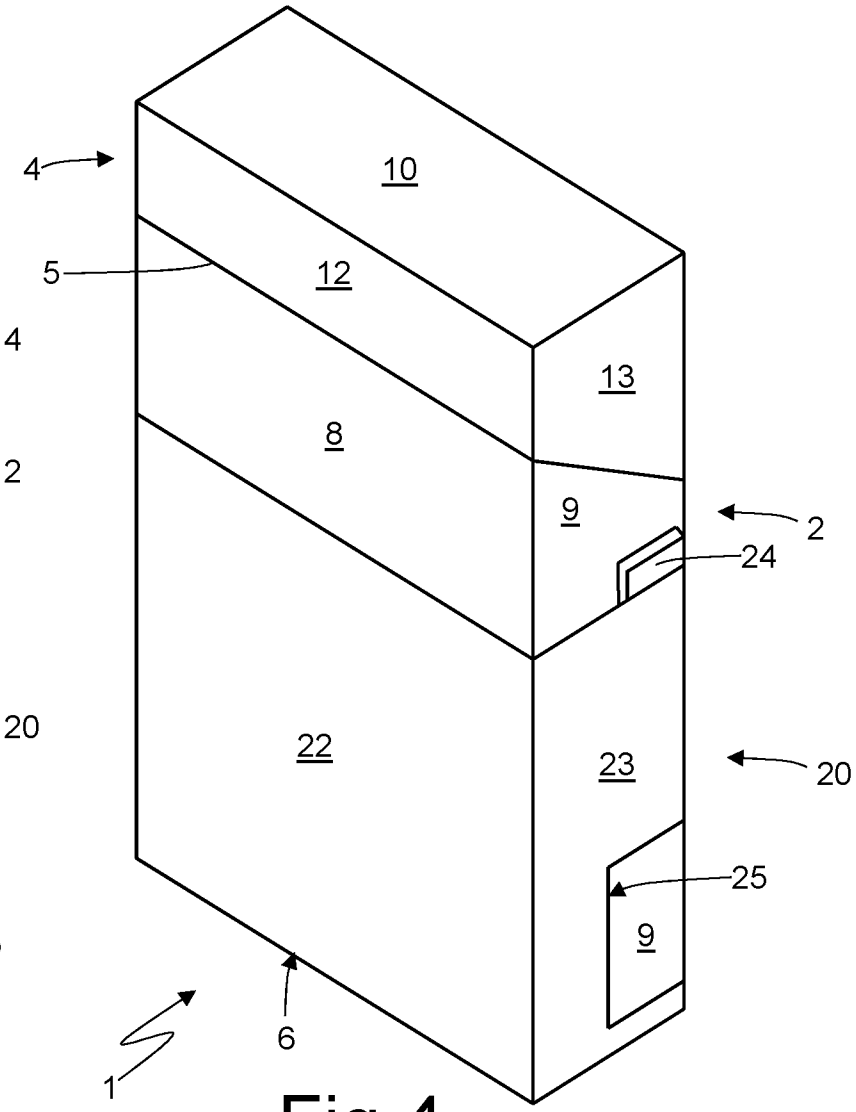
FIG. 4 is a rear perspective view of the pack of cigarettes of FIG. 1 in a closed configuration and with a deactivated locked opening of the lid.
Figure 3:
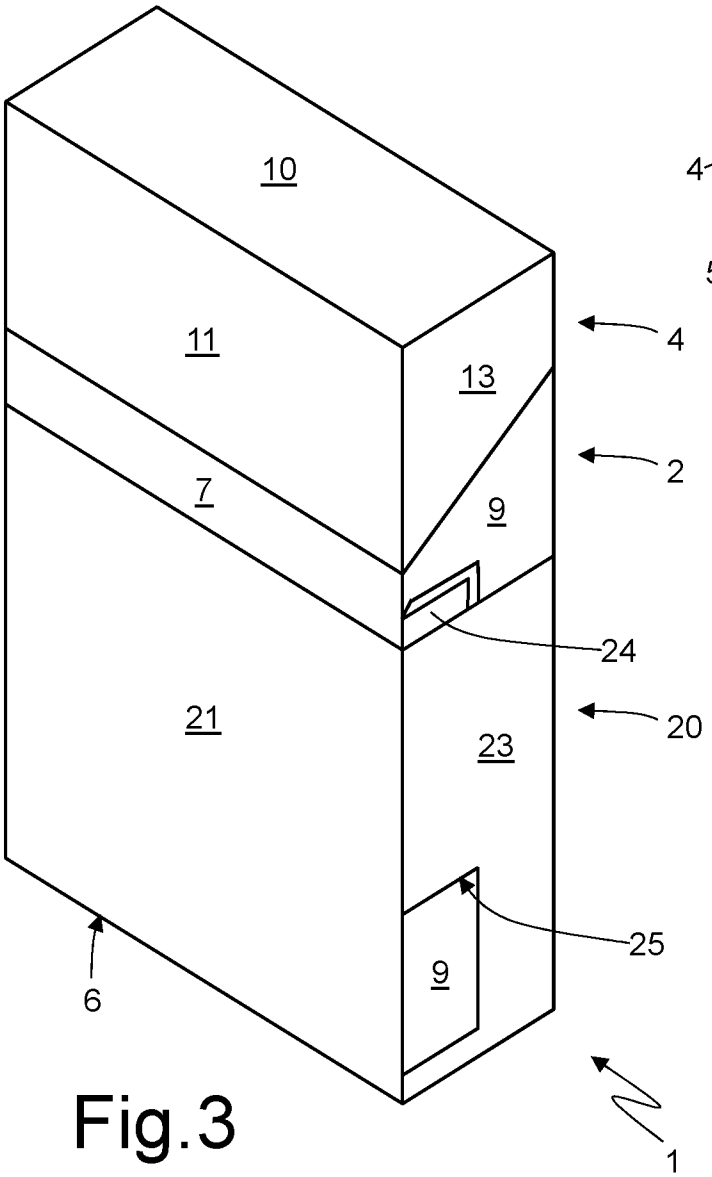
FIG. 3 is a front perspective view of the pack of cigarettes of FIG. 1 in a closed configuration and with a deactivated locked opening of the lid.
Figure 6:
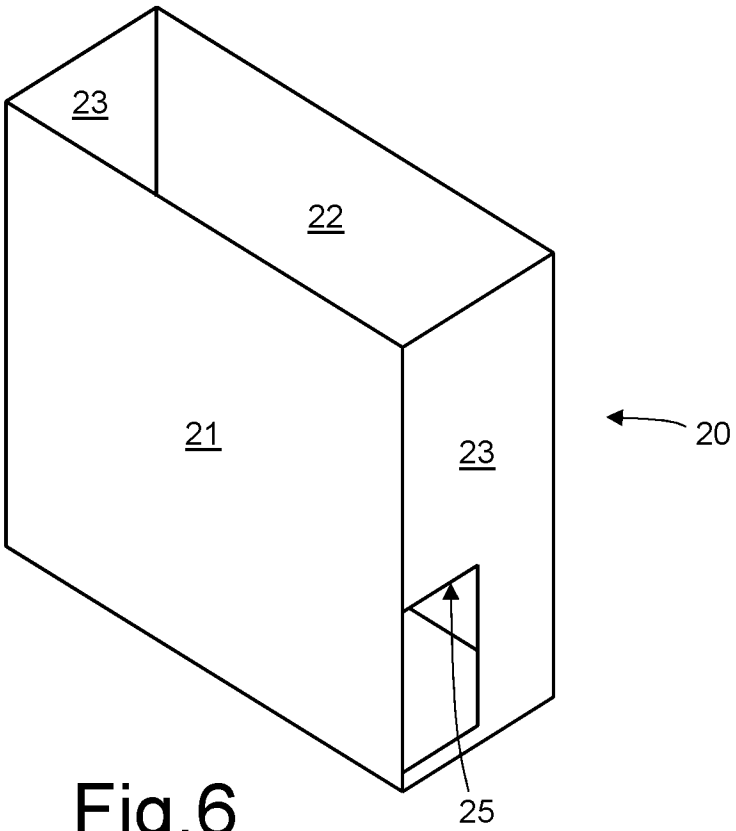
FIG. 6 is a front perspective view of a sliding sleeve of the pack of cigarettes of FIG. 1.
Figure 5:
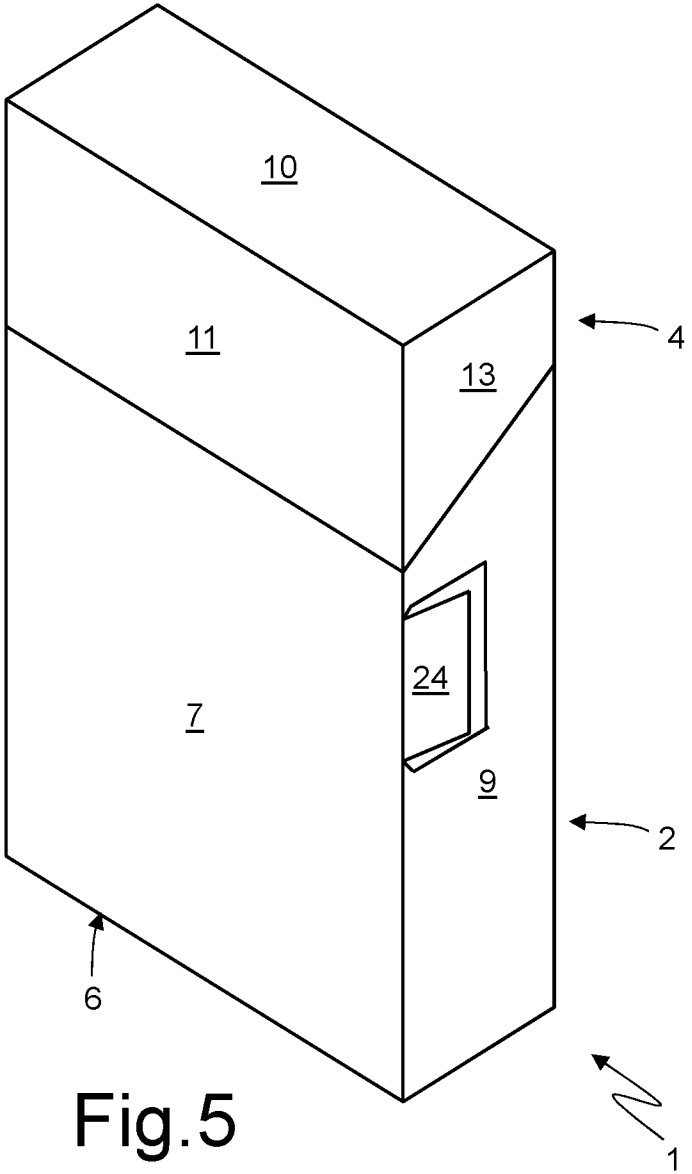
FIG. 5 is a front perspective view of the pack of cigarettes of FIG. 1 without a sliding sleeve.

As illustrated in FIGS. 1-6, the pack 1 of cigarettes comprises a locking system, which can be activated (as illustrated in FIGS. 1 and 2) to prevent the opening of the lid 4 from the closed position (i.e. the rotation of the lid 4 around the hinge 5 starting from the closed position) and can be deactivated (as illustrated in FIGS. 3 and 4) to allow the opening of the lid 4 from the closed position (i.e. the rotation of the lid 4 around the hinge 5 starting from the closed position).

The locking system comprises a sliding sleeve 20 which is arranged around the outer container 2 (and the lid 4) and is movable relative to the outer container 2 (and the lid 4) for sliding (linearly moving) along a sliding direction D longitudinally directed (i.e. perpendicular to the lower wall 6 of the outer container 2 and parallel to the walls 7, 8 and 9 of the outer container 2). In particular, the sliding sleeve can slide linearly (pushed by the fingers of the user of the pack of cigarettes) along the sliding direction D between a raised position (illustrated in FIGS. 1 and 2) in which the sliding sleeve 20 surrounds, at least partially, the lid 4 (preventing the rotation of the lid 4 and therefore preventing the opening of the lid 4 itself), and a lowered position (illustrated in FIGS. 3 and 4) in which the sliding sleeve is separate from the lid 4 (i.e. it does not surround the lid 4 thus allowing the rotation of the lid 4 and therefore allowing the opening of the lid 4). Consequently, to open the lid 4 it is necessary to first move the sliding sleeve 20 from the raised position (illustrated in FIGS. 1 and 2) to the lowered position (illustrated in FIGS. 3 and 4) by axially translating the sliding sleeve 20 along the sliding direction D.

In the embodiment illustrated in FIGS. 1-7, the sliding sleeve 20 has a tubular parallelepiped shape and is open both in the upper part and in the lower part; in particular, the sliding sleeve 20 has an open upper end and an open lower end opposite one another, a front wall 21 and a rear wall 22 parallel to and opposite one another, and two side walls 23 parallel to and opposite one another. Four longitudinal edges are defined between the front 21, rear 22 and side 23 walls of the sliding sleeve 20.

The locking system comprises two stop tabs 24 which are connected to the side walls 9 of the outer container 2 (i.e. they originate from the side walls 9 of the outer container 2), protrudes outwards from the outer container 2, and are hinged to the outer container 2 so as to be movable relative to the outer container 2. In particular, due to elastic return, the stop tabs 24 tend to detach (slightly) from the side walls 9 of the outer container 2 (as illustrated, for example, in FIG. 5), i.e. in the absence of outer constraints the stop tabs 24 are arranged in a position (slightly) detached from the side walls 9 of the outer container 2; obviously, by pushing on the stop tabs 24, it is possible to make the stop tabs 24 adhere to the side walls 9 of the outer container 2.

Furthermore, the locking system comprises two stop openings 25 which are made through the two side walls 23 of the sliding sleeve 20 and are (slightly) larger than the stop tabs 24 so that the stop tabs 24 can get through them; in particular, between the width of the stop openings 25 and the width of the stop tabs 24 there is a given clearance, different from zero (but not too large), so that each stop tab 24 can pass through a corresponding stop opening 25 easily.

In the embodiments illustrated in the attached Figures, the stop tabs 24 and the stop openings 25 have a rectangular shape; according to other embodiments which are not illustrated and are perfectly equivalent, the stop tabs 24 and/or the stop openings 25 have a shape different from the rectangular shape.

When the sliding sleeve 20 is in the raised position (illustrated in FIGS. 1 and 2), the two stop openings 25 of the sliding sleeve 20 are aligned and overlap the stop tabs 24 of the outer container 2 and therefore, by elastic return, the two stop tabs 24 pass through the stop openings 25 and then protrude from the stop openings 25; in this condition, the stop tabs 24 prevent sliding movement of the sliding sleeve 20 and therefore in order to slide the sliding sleeve 20 (i.e. to move the sliding sleeve 20 from the raised position to the lowered position) it is necessary that the user presses the stop tabs 24 against the side walls 9 of the outer container 2 and simultaneously push (pull) the sliding sleeve 20 downwards.

When the sliding sleeve 20 is in the lowered position (illustrated in FIGS. 3 and 4), the two stop openings 25 of the sliding sleeve 20 are not aligned and overlap the stop tabs 24 of the outer container 2 (rather they are relatively far from the stop tabs 24 of the outer container 2) and the stop tabs 24 of the outer container 2 are kept pressed against the side walls 9 of the outer container 2 by the side walls 23 of the sliding sleeve 20. Consequently, when the sliding sleeve is in the lowered position (illustrated in FIGS. 3 and 4), the sliding sleeve 20 can freely slide relative to the outer container 2, i.e. it can slide relative to the outer container 2 without performing any additional operation.

In other words, when the sliding sleeve 20 is in the raised position (illustrated in FIGS. 1 and 2) the stop tabs 24 are inserted in the stop openings 25 and therefore prevent the sliding sleeve 20 from sliding relative to the outer container 2; on the other hand, when the sliding sleeve 20 is in the lowered position (illustrated in FIGS. 3 and 4) the stop tabs 24 are not inserted in the stop openings 25 and therefore do not prevent the sliding sleeve 20 from sliding relative to the outer container 2.

According to a different embodiment not illustrated, the outer container 2 comprises two pairs of stop tabs 24 which are identical and vertically offset: a first pair of stop tabs 24 prevents (until the stop tabs 24 are pressed against the side walls 9 of the outer container 2) the sliding movement of the sliding sleeve 20 starting from the raised position (illustrated in FIGS. 1 and 2), while a second pair of stop tabs 24 prevents (until the stop tabs 24 are pressed against the side walls 9 of the outer container 2) the sliding of the sliding sleeve 20 starting from the lowered position (illustrated in FIGS. 3 and 4).

Figure 10:
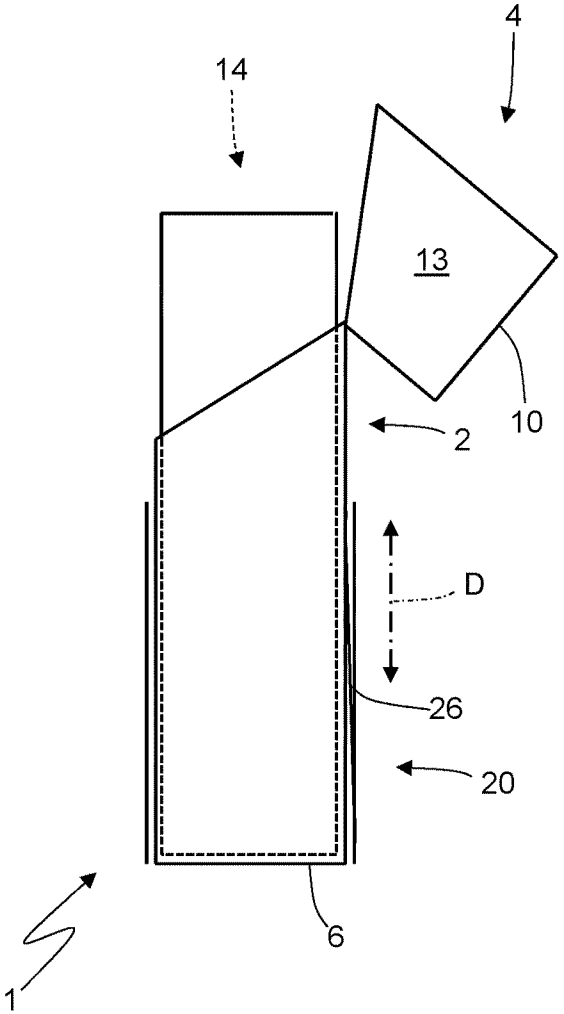
FIGS. 8, 9 and 10 are three schematic and side views of the pack of cigarettes of FIG. 1 during an opening of the lid.
Figure 9:
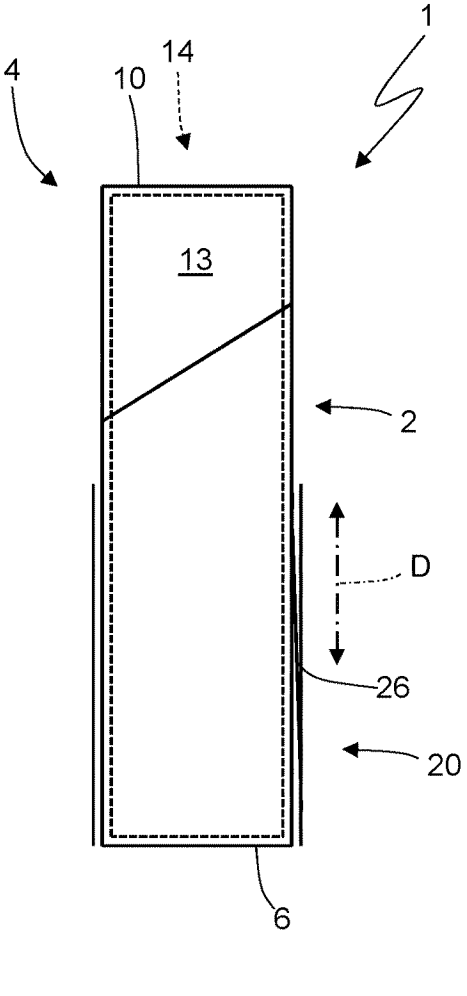
Figure 8:
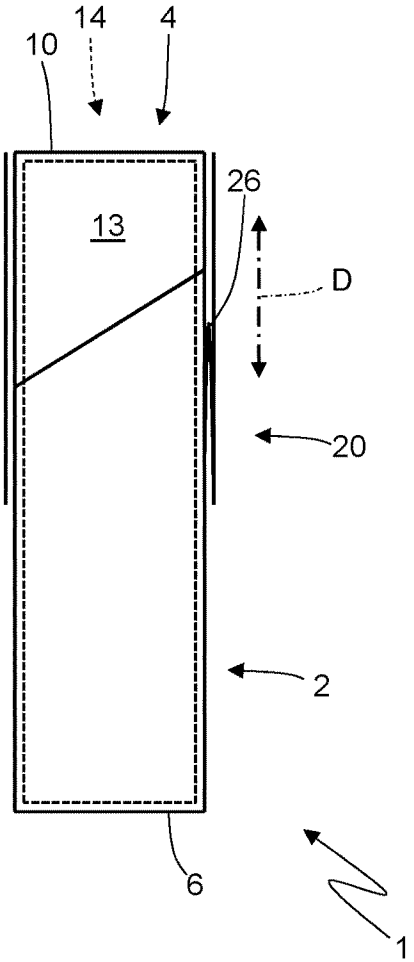
Figure 15:
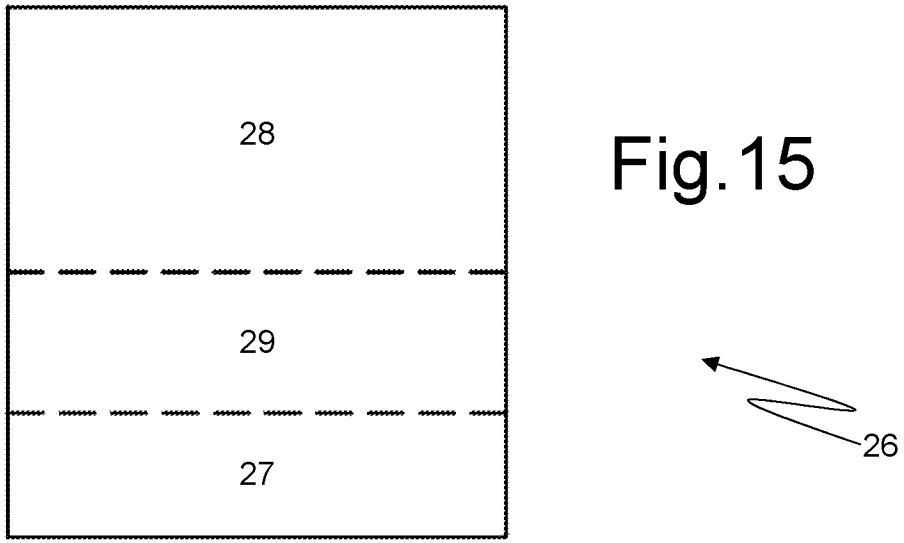
FIG. 15 is a plan view of an extended connecting element of the pack of cigarettes of FIG. 1.

According to a preferred embodiment illustrated in FIGS. 8, 9 and 10, the locking system comprises a limit stop tab 26 which prevents the sliding sleeve 20 from being separated from the outer container 2 by limiting the maximum sliding movement of the sliding sleeve 20 relative to the outer container 2. According to what illustrated in FIG. 15, the limit stop tab 26 comprises an inner portion 27 which is glued to the rear wall 8 of the outer container 2, an outer portion 28 which is glued to the rear wall 22 of the sliding sleeve 20, and an intermediate portion 29 connecting (joining) the inner portion 27 to the outer portion 28 (in particular it is hinged on one side to the inner portion 27 and is hinged on the opposite side to the outer portion 28) and is deformable. When the sliding sleeve 20 is in the raised position (illustrated in FIGS. 1, 2 and 8), the limit stop tab 26 assumes a "Z"-shape (i.e. a "compressed" shape that, by folding back on itself reduces the size of the limit stop tab 26), while when the sliding sleeve 20 is in the lowered position (illustrated in FIGS. 3-4, 7 and 9-10), the limit stop tab 26 takes on assumes an extended shape (i.e. an "expanded" shape which gives the maximum length to the limit stop tab 26).

According to a different embodiment not illustrated, the limit stop tab 26 is not present and therefore the sliding sleeve 20 can potentially be separated from the outer container 2.

Figure 16:
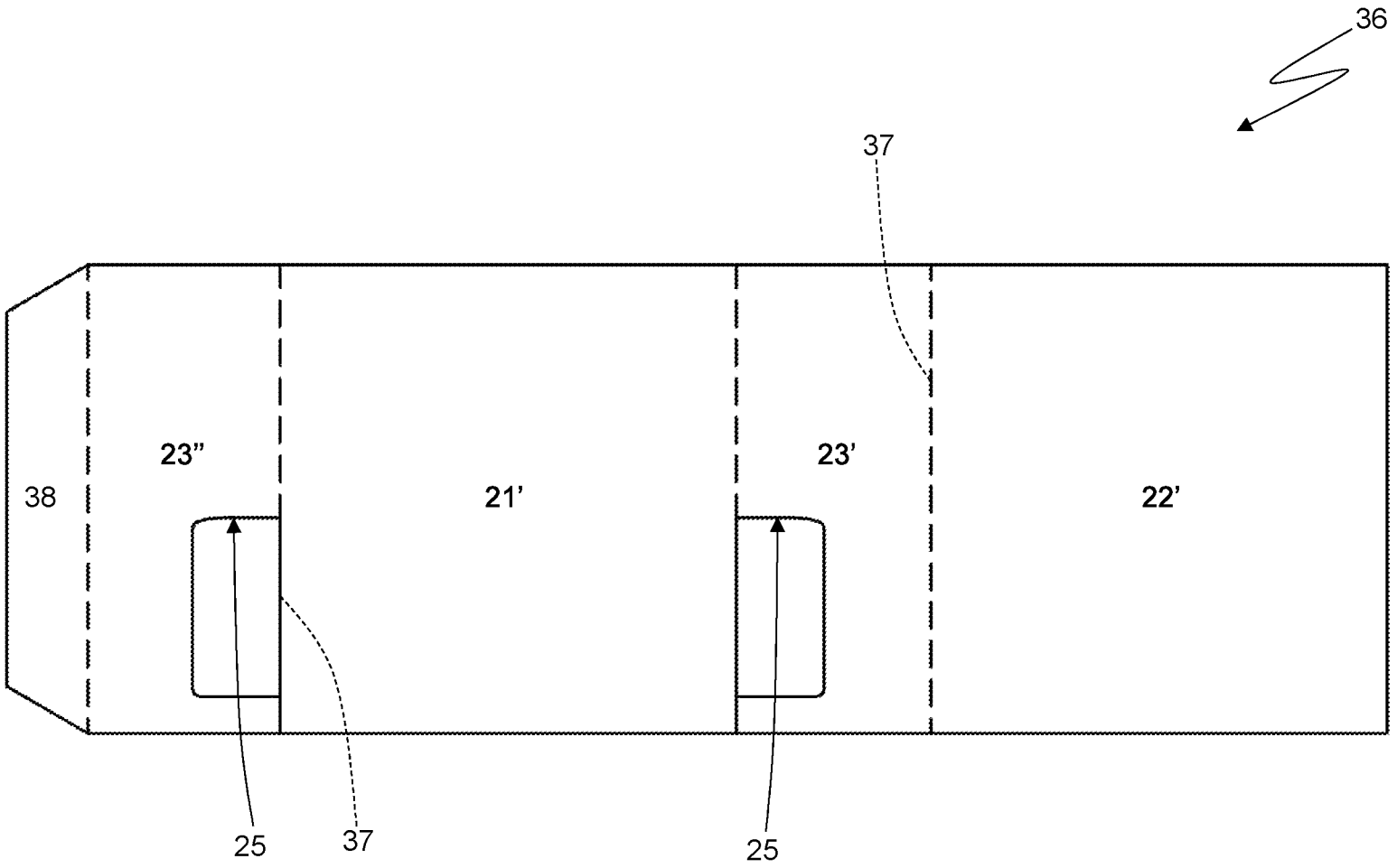
FIG. 16 is a plan view of a blank used to make a sliding sleeve of the pack of cigarettes of FIG. 1.
Figure 17:
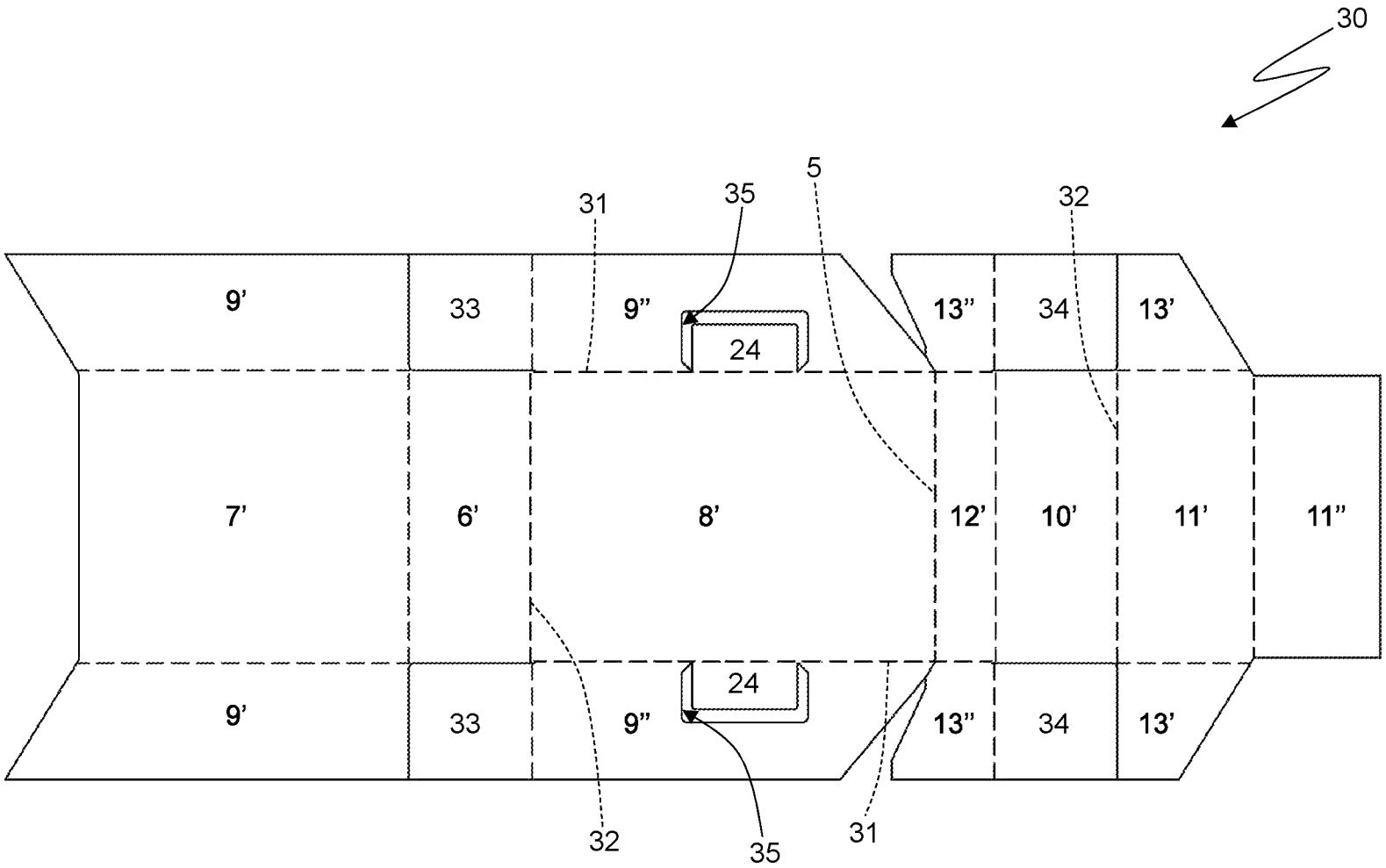
FIG. 17 is a plan view of an alternative of the blank of FIG. 13.
Figure 18:
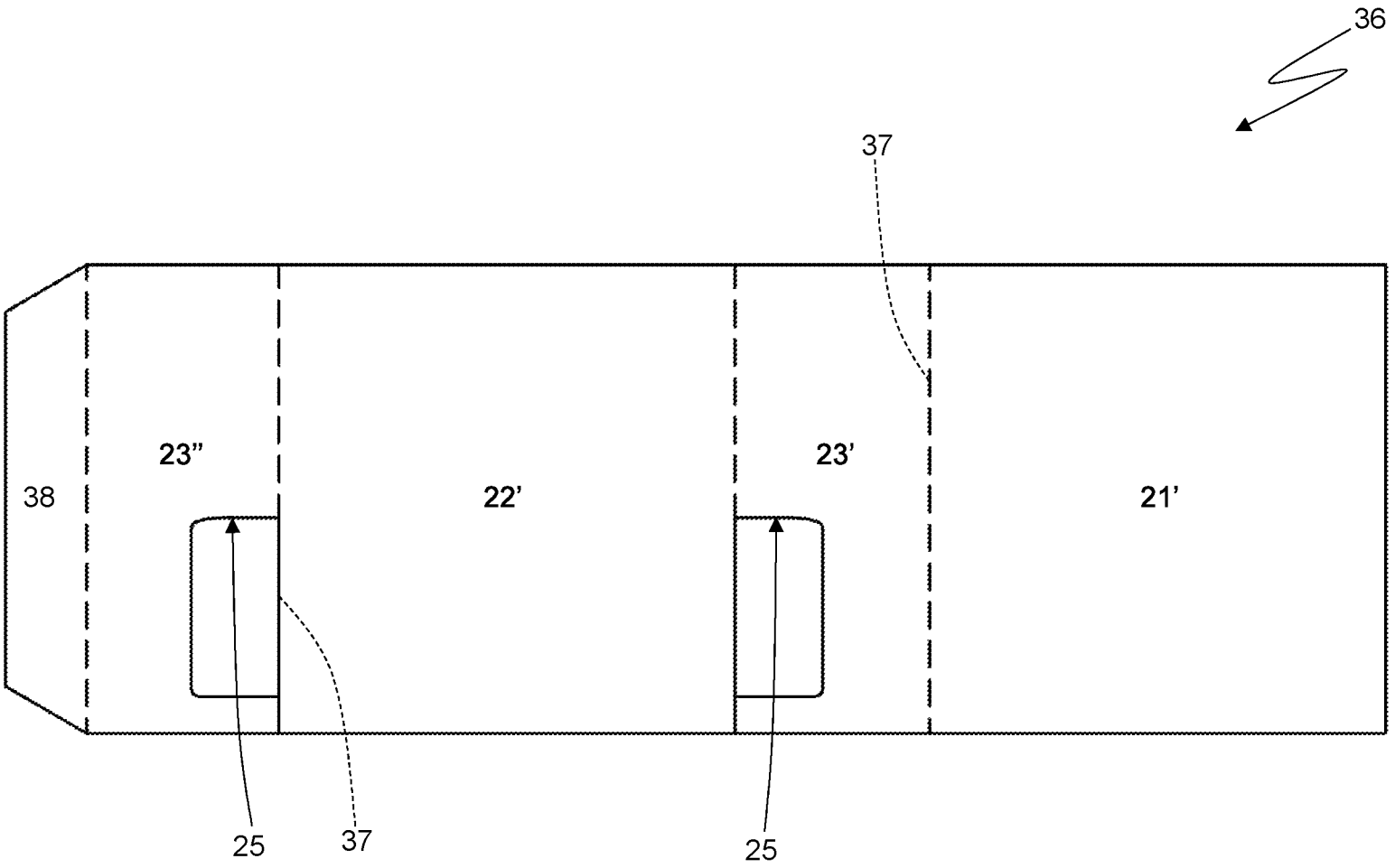
FIG. 18 is a plan view of an alternative of the blank of FIG. 16 which is combined with the blank of FIG. 17.

In the embodiment illustrated in FIGS. 1-16, the stop tabs 24 originate from the front longitudinal corners astride the side walls 9 of the outer container 2 and the front wall 7 of the outer container 2; according to a different embodiment illustrated in FIGS. 17 and 18, the stop tabs 24 originate from the rear longitudinal corners astride the side walls 9 of the outer container 2 and the front wall 7 of the outer container 2. Obviously, the stop openings 25 must always be arranged at the stop tabs 24, therefore if the position of the stop tabs 24 varies, the position of the stop openings 25 must also vary accordingly.

Figure 24:
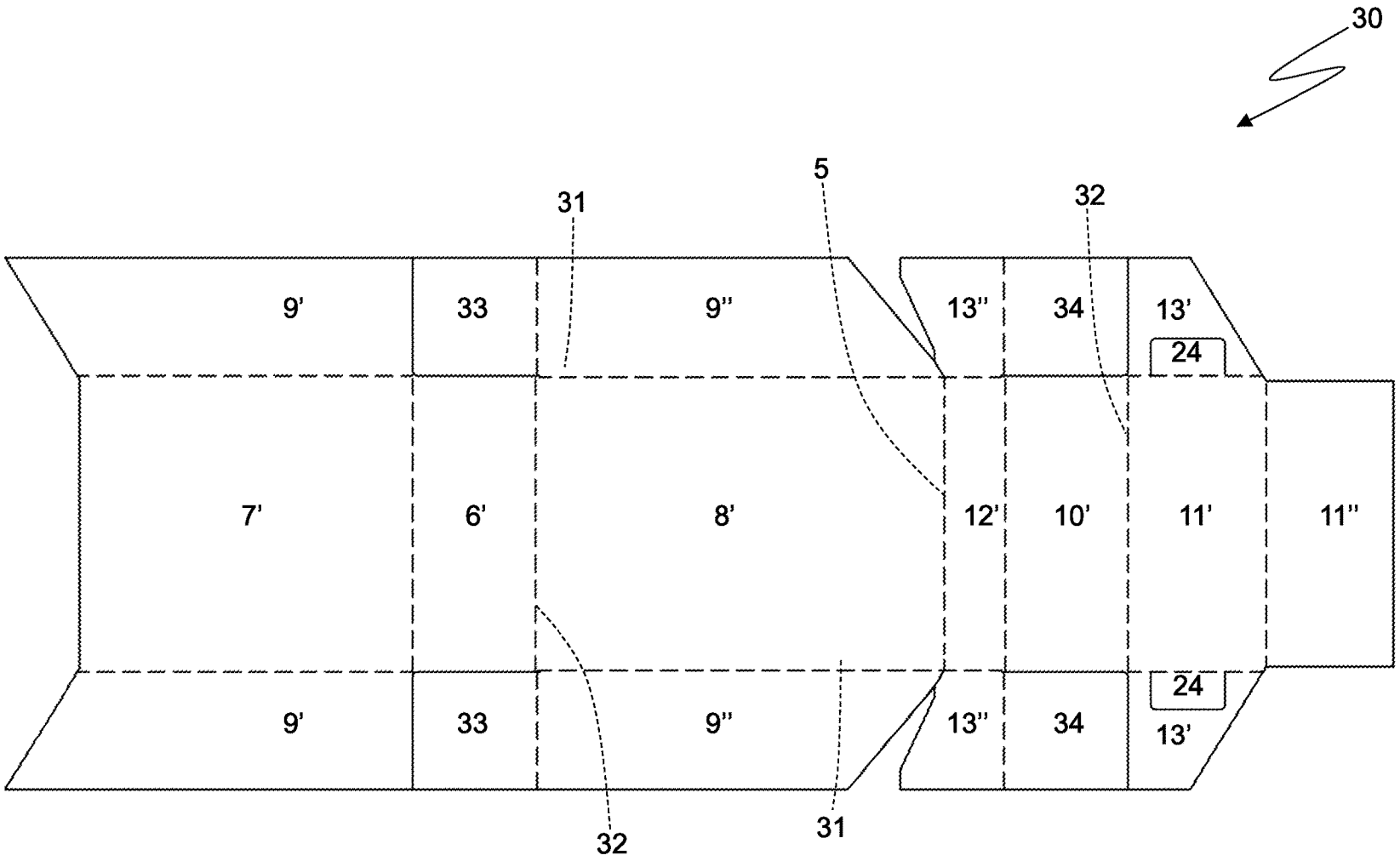
FIG. 24 is a plan view of a further alternative of the blank of FIG. 13.

In the embodiments illustrated in the attached Figures, the stop tabs 24 are arranged at the side walls 9 of the outer container 2; according to other embodiments not illustrated, the stop tabs 24 are arranged at the front wall 7 of the outer container 2, at the rear wall 8 of the outer container 2, at the side walls 13 of the lid 4 (FIG. 24), at the front wall 11 of the lid 4, or at the rear wall 12 of the lid 4.

In the embodiments illustrated in the attached Figures, two stop tabs 24 are provided; according to different embodiments not illustrated, a single stop tab 24 is provided or more than two (typically three or four) stop tabs 24 are provided. In other words, in general the locking system comprises at least one stop tab 24 that is connected to a wall 7, 8 or 9 of the outer container 2 or to a wall 11, 12 or 13 of the lid 4, and at least one stop opening 25, made in the sliding sleeve and is adapted to be crossed by the stop tab 24 when the sliding sleeve 20 is in the raised position (illustrated in FIGS. 1 and 2).

Figure 13:
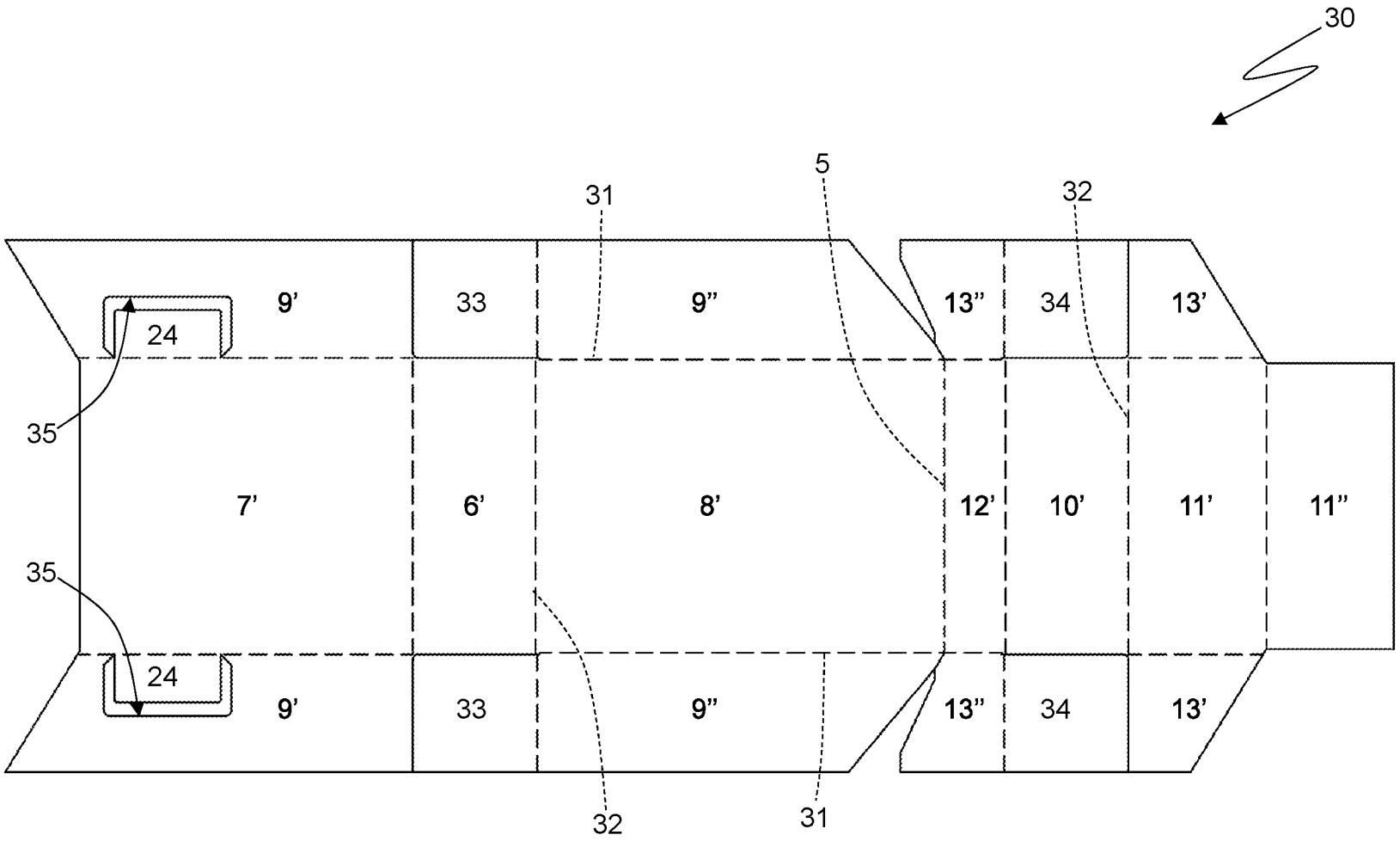
FIG. 13 is a plan view of a blank used to make an outer container and a hinged lid of the pack of cigarettes of FIG. 1.

As illustrated in FIG. 13, the outer container 2 and the lid 4 are made by folding a rigid blank 30 of a conventional type and provided with a plurality of pre-weakened folding lines 31 and 32. The blank 30 comprises two longitudinal folding lines 31 (pre-weakened) and a plurality of transverse folding lines 32 (pre-weakened) which define, between the two longitudinal folding lines 31, a panel 7' that forms the front wall 7 of the outer container 2, a panel 6' that forms the lower wall 6 of the outer container 2, a panel 8' that forms the rear wall 8 of the outer container 2, a panel 12' that forms the rear wall 12 of the lid 4, a panel 10' that forms the upper wall 10 of the lid 4, a panel 11' that forms the front wall 11 of the lid 4, and a reinforcement end flap 11".

The reinforcement end flap 11" is connected to the front wall 11 of the lid 4 along a transverse folding line 32, it is folded by 180° (in the pack 1 of cigarettes) relative to the front wall 11 of the lid 4 (i.e. relative to the panel 11'), and rests and is glued onto an inner surface of the front wall 11 of the lid 4 (i.e. onto the panel 11').

The blank 30 comprises a pair of flaps 9', which are arranged on opposite sides of the panel 7', are connected to the panel 7' along the two longitudinal folding lines 31, and form part of the side walls 9 of the outer container 2. The blank 30 comprises a pair of flaps 9", which are arranged on opposite sides of the panel 8', are connected to the panel 8' along the two longitudinal folding lines 31, form part of the side walls 9 of the outer container 2, and they overlap and are glued to the corresponding flaps 9' so as to form the side walls 9 of the outer container 2. In the embodiment illustrated in FIG. 13, the flaps 9' (in which the stop tab 24 are obtained) are arranged on the outside and then are at last folded over the flaps 9" (as normally occurs in standard packaging machines); in the embodiment illustrated in FIG. 17, the flaps 9" (in which the stop tab 24 are obtained) are arranged on the outside and then are at last folded over the flaps 9' (unlike what normally occurs in standard packaging machines).

The blank 30 comprises a pair of flaps 13', which are arranged on opposite sides of the panel 11', are connected to the panel 11' along the two longitudinal folding lines 31, and form part of the side walls 13 of the lid 4. The blank 30 comprises a pair of flaps 13", which are arranged on opposite sides of the panel 12', are connected to the panel 12' along the two longitudinal folding lines 31, form part of the side walls 13 of the lid 4, overlaps and are glued to the corresponding tabs 13' so as to form the side walls 13 of the lid 4.

The blank 30 comprises two tabs 33 which are connected to the flaps 9" along a transverse folding line 32, are folded by 90° and rest against an inner surface of the panel 6'.

The blank 30 comprises two tabs 34 which are connected to the flaps 13" along a transverse folding line 32, are folded by 90° and rest against an inner surface of the panel 10'.

Each stop tab 24 is obtained in a corresponding panel 9' and therefore affects only the panel 9' (i.e. does not affect the corresponding panel 9"); according to a different embodiment not illustrated, each stop tab 24 is formed by the overlapping of a part of the corresponding panel 9' and a part of the corresponding panel 9" glued to one another.

In the embodiment illustrated in the attached Figures, each stop tab 24 is arranged inside a window 35 which passes through the corresponding panel 9' and is (slightly) larger than the stop tab 24; in this way, the stop tab 24 has no residual contact point with the rest of the panel 9' (apart from the hinge line) and therefore does not have any kind of impediment to separate, by elastic return, from the remaining part of the panel 9'. That is, in this embodiment, each stop tab 24 is obtained in the corresponding panel 9' by means of two "U"-shaped through incisions which originate from the same longitudinal folding line 31: the innermost through incision delimits the stop tab 24 while the outermost through incision delimits the window 35 (the material comprised between the two through incisions is eliminated for forming the window 35).

As illustrated in FIG. 16, the sliding sleeve 20 is made by folding a rigid blank 36 provided with a plurality of longitudinal (pre-weakened) folding lines 37, which define a panel 21' that forms the front wall 21 of the sliding sleeve 20, a panel 23' that forms a side wall 23 of the sliding sleeve 20, a panel 22' that forms the rear wall 22 of the sliding sleeve 20, a panel 23" that forms the other side wall 23 of the sliding sleeve 20, and a tab 38 which is folded by 90° and is glued to an inner surface of the panel 21'.

Figure 19:
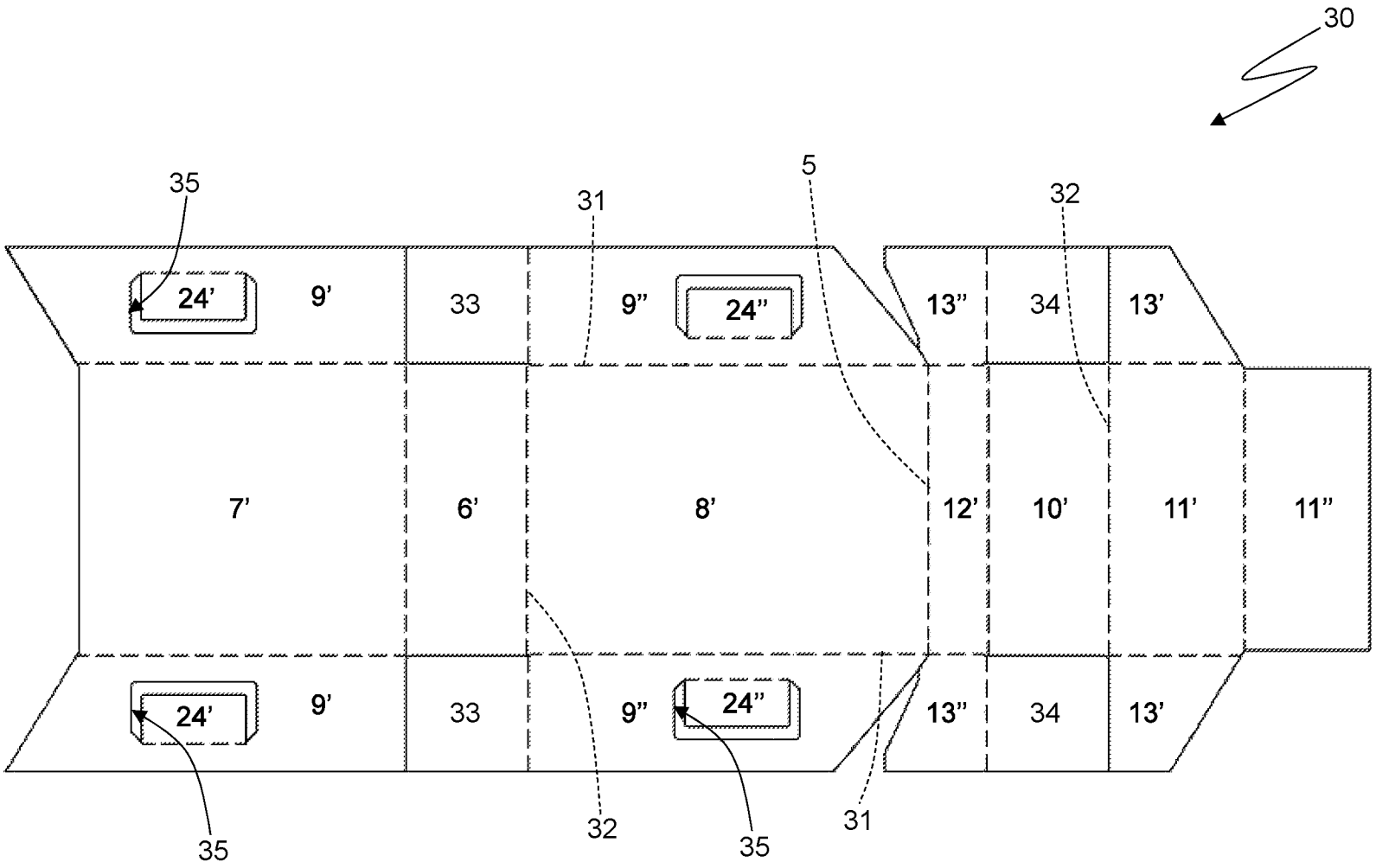
FIG. 19 is a plan view of a further alternative of the blank of FIG. 13.

In the blank 30 illustrated in FIG. 19, each stop tab 24 is formed by the union of two parts 24' and 24", which overlap and are glued to one another, i.e. each stop tab 24 is formed by the union of a part 24', obtained in a corresponding tab 9' and of a part 24" obtained in a corresponding tab 9". In this embodiment, the stop tabs 24 are not resting against a longitudinal edge (i.e. they do not originate from a longitudinal edge), but are arranged approximately in the centre of the side walls 9 of the outer container 2.

The embodiments illustrated in FIGS. 20-23 differ from the embodiments illustrated in FIGS. 1-19 in that the sliding sleeve 20 is higher (i.e. it has the same height as the outer container 2 provided with the lid 4); as a consequence, in the raised position the sliding sleeve 20 completely covers (i.e. leaving only the upper wall 10 of the lid 4 in view) the container 2 and the lid 4. Furthermore, the embodiments illustrated in FIGS. 20-23 differ from the embodiments illustrated in FIGS. 1-19 in that the sliding sleeve 20 comprises a lower wall 39 provided with a through hole 40 through which a user can insert a finger so as to push on the lower wall 6 of the outer container 2 and then partially extract the outer container 2 provided with the lid 4 from the sliding sleeve 20 (an operation which, as mentioned above, can only take place by pressing at the same time the stop tabs 24 against the side walls 9 of the outer container 2).

Figure 20:
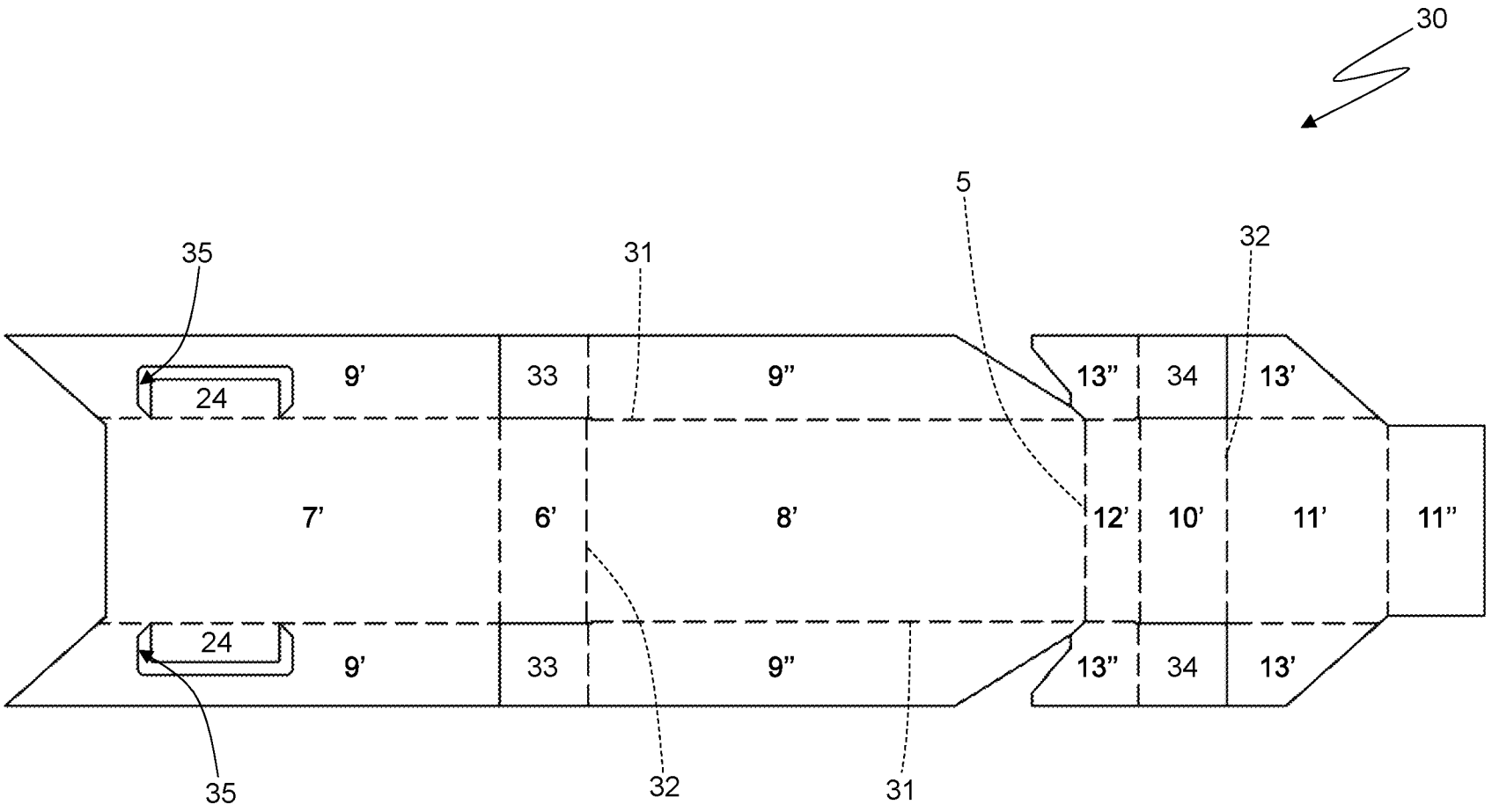
FIG. 20 is a plan view of another alternative of the blank of FIG. 13.
Figure 21:
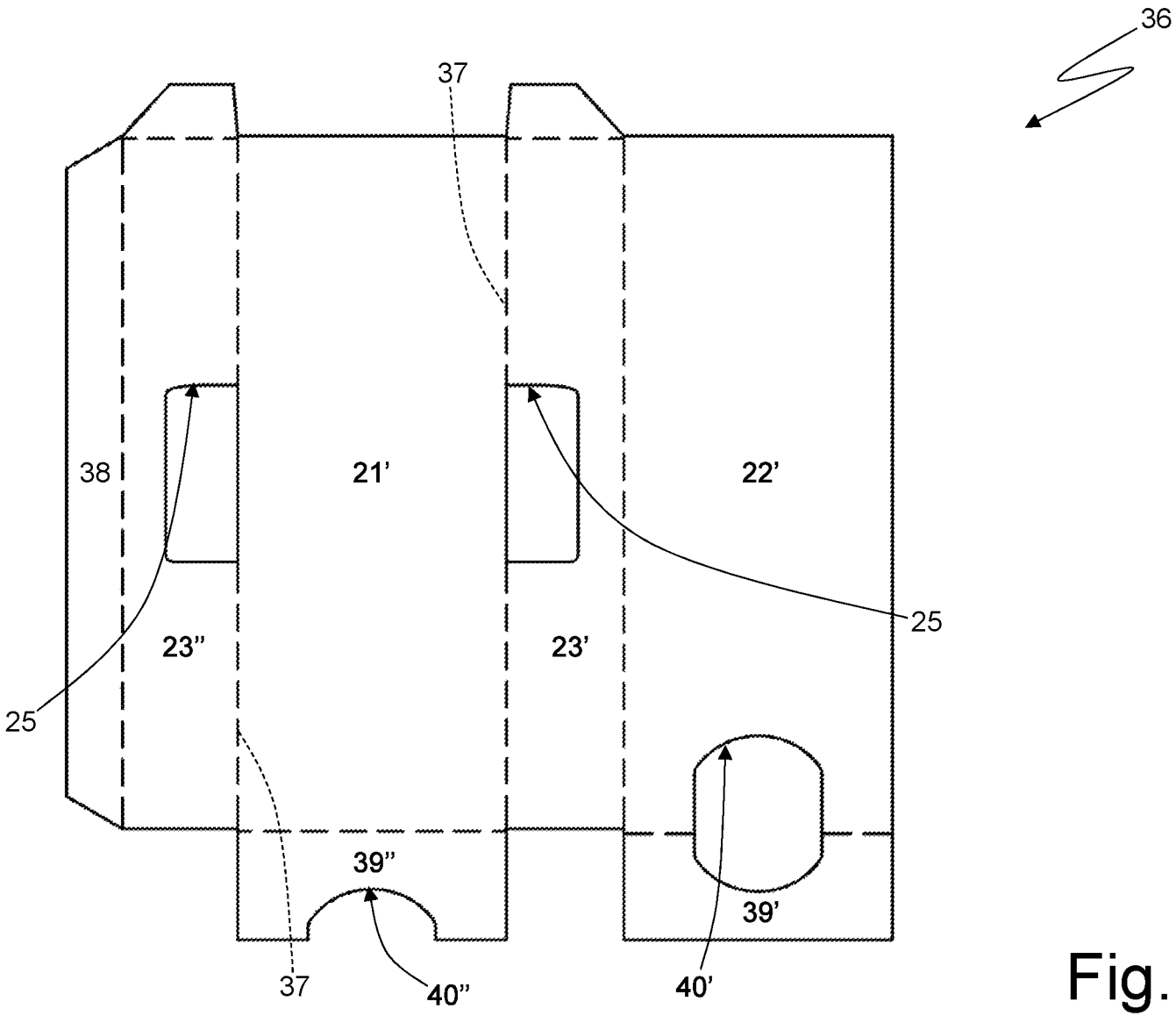
FIG. 21 is a plan view of another alternative of the blank of FIG. 16 which is combined with the blank of FIG. 20.

The embodiment illustrated in FIGS. 20 and 21 differs from the other embodiments illustrated in FIGS. 1-19 and 22-23 by the different proportion in the longitudinal and transverse dimensions (in particular the pack 1 of cigarettes is narrower).

Figure 22:
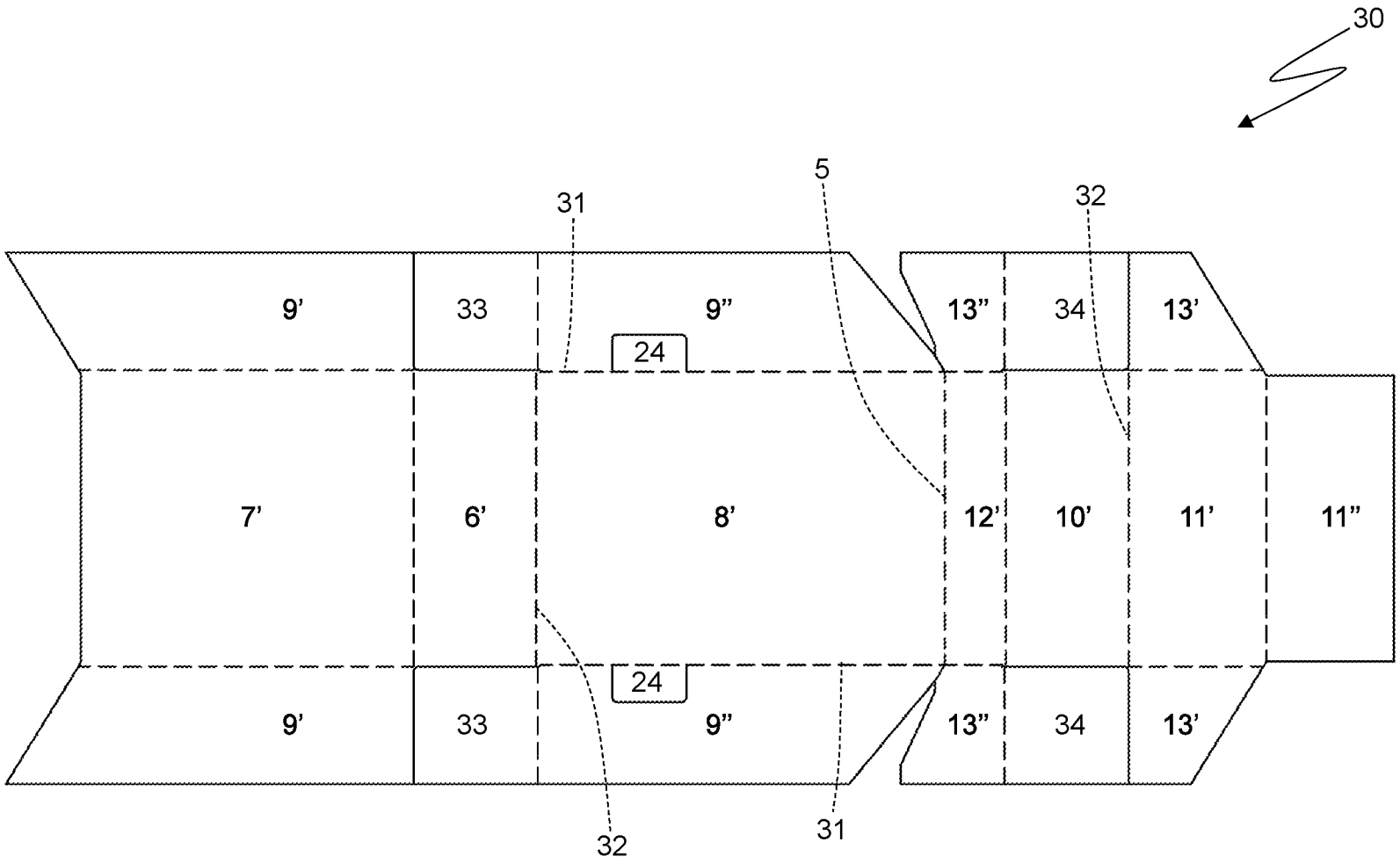
FIG. 22 is a plan view of a further alternative of the blank of FIG. 13.
Figure 23:
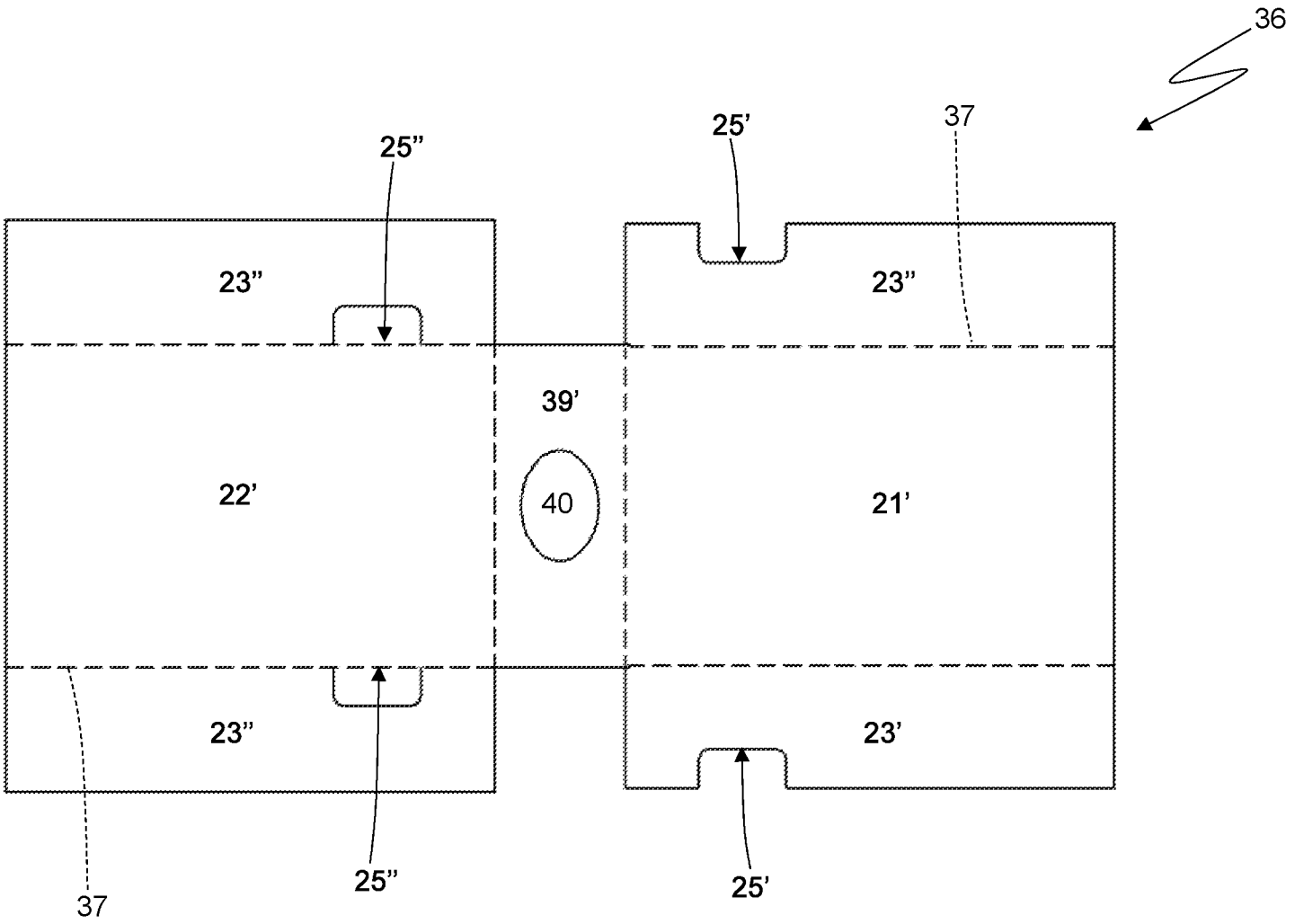
FIG. 23 is a plan view of a further alternative of the blank of FIG. 16 which is combined with the blank of FIG. 2.

The embodiment illustrated in FIGS. 22 and 23 differs from the other embodiments illustrated in FIGS. 1-21 for the absence of the windows 35 around the stop tabs 24, i.e. in this embodiment each stop tab 24 is obtained in the corresponding panel 9' by means of a single "U"-shaped through incision which originates from a longitudinal folding line 31.

The blanks 36 illustrated in FIGS. 16, 18, 19 and 21 have a horizontal development (consequently in the blank 36 illustrated in FIG. 21 the lower wall 39 of the sliding sleeve is formed by the overlapping of two flaps 39' and 39") while the blank 36, illustrated in FIG. 23, has a vertical development (consequently in the blank 36 illustrated in FIG. 23 the side walls 23 of the sliding sleeve 20 are formed by the overlapping of two respective flaps 23' and 23", each provided with its own stop opening 25' or 25").

In the embodiments illustrated in the attached Figures, the longitudinal and transverse edges are straight; alternatively, the longitudinal and/or transverse edges could be rounded or bevelled.

In the embodiments illustrated in the attached Figures, the pack 1 of cigarettes contains a group of cigarettes; alternatively, the pack 1 of cigarettes can contain any other type for smoking articles such as cigars, electric or electronic cigarettes (i.e. cigarettes that generate an aerosol without combustion), cartridges and refills for electronic cigarettes, new generation cigarettes.

The embodiments described herein can be combined with each other without departing from the scope of the present invention. The pack 1 of cigarettes described above has numerous advantages.

First, the pack 1 of cigarettes described above can be classified as "child-proof", that is, capable of preventing children from opening the same. In fact, to open the pack 1 of cigarettes described above it is not sufficient to rotate the lid 4 but it is necessary to first move the sliding sleeve 20 from the raised position (illustrated in FIGS. 1 and 2) to the lowered position (illustrated in FIGS. 3 and 4) by deactivating, therefore, the locking system (i.e. by passing from what is illustrated in FIGS. 1 and 2 to what is illustrated in FIGS. 3 and 4); in other words, to open the pack 1 of cigarettes described above it is necessary to carry out a particular sequence of movements which are not intuitive for a child. Obviously, this provides that initially the pack 1 of cigarettes is made with the sliding sleeve 20 in the raised position (illustrated in FIGS. 1 and 2).

After the first opening of the pack 1 of cigarettes, the user is free to decide whether to leave the locking system deactivated (as illustrated in FIGS. 3 and 4) and therefore allow the subsequent opening of the lid 4 without having to further touch the locking system, or whether to activate the locking system again (as illustrated in FIGS. 1 and 2) and therefore require, at the subsequent opening of the lid 4 to necessarily move the sliding sleeve 20 back to the lowered position (illustrated in FIGS. 3 and 4).

Furthermore, the pack 1 of cigarettes described above, although classifiable as "child-proof", nevertheless presents relatively simple and predictable opening methods for an adult.

Finally, the pack 1 of cigarettes described above can be made in a packaging machine that is not too different from a standard packaging machine for a rigid pack of cigarettes with hinged lid; consequently, the preparation of a packaging machine for the production of the pack 1 of cigarettes described above does not require particularly high costs.

LIST OF REFERENCE NUMBERS OF THE FIGURES

1 pack of cigarettes
2 outer container
3 open upper end
4 lid
5 hinge
6 lower wall
7 front wall
8 rear wall
9 side walls
10 upper wall
11 front wall
12 rear wall
13 side walls
14 collar
15 front wall
16 side walls
17 projections
18 inner wrap
19 group of cigarettes
20 sliding sleeve
21 front wall
22 rear wall
23 side walls
24 stop tabs
25 stop openings
26 limit stop tab
27 inner portion
28 outer portion
29 intermediate portion
30 blank
31 longitudinal folding lines
32 transverse folding lines
33 tabs
34 tabs
35 window
36 blank
37 longitudinal folding lines
38 tabs
39 lower wall
40 hole
D sliding direction

The invention claimed is:

1. A pack (1) for smoking articles comprising:

a rigid outer container (2), which is cup-shaped and has: an open upper end (3), a lower wall (6) opposite the open upper end (3), a front wall (7) and a rear wall (8) opposite one another, and two side walls (9) opposite one another;

a lid (4), which is cup-shaped, is hinged to the outer container (2) along a hinge (5) so as to rotate, relative to the outer container (2), between an open position and a closed position, and has: an open lower end, an upper wall (10), a front wall (11) and a rear wall (12) opposite one another, and two side walls (13) opposite one another;

a group (19) of smoking articles;

an inner wrap (18), which houses the group (19) of smoking articles and is arranged in the outer container (2); and a locking system, which can be activated to prevent the lid (4) from rotating from the closed position and can be deactivated to allow the lid (4) to rotate from the closed position;

wherein the locking system comprises a sliding sleeve (20), which is arranged around the outer container (2) and is movable relative to the outer container (2) in order to slide along a sliding direction (D) between a raised position, in which the sliding sleeve (20) at least partially surrounds the lid (4), thus preventing the lid (4) from rotating from the closed position, and a lowered position, in which the sliding sleeve (20) is separate from the lid (4), thus allowing the lid (4) to rotate from the closed position;

wherein the locking system comprises: at least one stop tab (24); and at least one stop opening (25) which is made in the sliding sleeve (20), is larger than the stop tab (24) so that the stop tab (24) can get through it, is aligned with and overlaps the stop tab (24) when the sliding sleeve (20) is in the raised position so that, when the sliding sleeve (20) is in the raised position, the stop tab (24) comes out of the stop opening (25); wherein the stop tab (24) is connected to a wall (7; 8; 9) Of the outer container (2), protrudes outwards from the outer container (2), and is hinged to the outer container (2) so as to be movable relative to the outer container (2); or, alternatively, the stop tab (24) is connected to a wall (11; 12; 13) of the lid (4), protrudes outwards from the lid (4), and is hinged to the lid (4) so as to be movable relative to the lid (4); and wherein the stop tab (24) is obtained in the corresponding wall (7; 8; 9) of the outer container (2) or in the corresponding wall (11; 12; 13) of the lid (4) by means of a "U"-shaped through incision, which originates from a folding line (31).

2. The pack (1) for smoking articles according to claim 1, wherein the stop tab (24), due to an elastic return effect, tends to detach itself from the corresponding wall (7; 8; 9) of the outer container (2) or from the corresponding wall (11; 12; 13) of the lid (4), namely, in the absence of outer constraints, the stop tab (24) is arranged in a detached position from the corresponding wall (7; 8; 9) of the outer container (2) or from the corresponding wall (11; 12; 13) of the lid (4).

3. The pack (1) for smoking articles according to claim 1, wherein the stop tab (24) is connected to a wall (7; 8; 9) of the outer container (2), protrudes outwards from the outer container (2), and is hinged to the outer container (2) so as to be movable relative to the outer container (2).

4. The pack (1) for smoking articles according to claim 3, wherein the locking system comprises:

two stop tabs (24), which are connected to the side walls (9) of the outer container (2), protrudes outwards from the outer container (2), and are hinged to the outer container (2) so as to be movable relative to the outer container (2); and two stop openings (25) which are made through two side walls (23) of the sliding sleeve (20) and are larger than the stop tabs (24) so that the stop tabs (24) can get through them.

5. The pack (1) for smoking articles according to claim 4, wherein the stop tabs (24) originate from rear longitudinal corners astride the side walls (9) of the outer container (2) and the rear wall (8) of the outer container (2).

6. The pack (1) for smoking articles according to claim 4, wherein the stop tabs (24) originate from front longitudinal corners astride the side walls (9) of the outer container (2) and the front wall (7) of the outer container (2).

7. The pack (1) for smoking articles according to claim 4, wherein:

each side wall (9) of the outer container (2) is formed by two panels (9', 9"), which overlap and are glued to one another; and each stop tab (24) is obtained only in an outer panel (9'; 9") and is not present in an inner panel (9"; 9') of the corresponding side wall (9) of the outer container (2).

8. The pack (1) for smoking articles according to claim 1, wherein the stop tab (24) is arranged inside a through window (35) in the corresponding wall (7; 8; 9) of the outer container (2) or in the corresponding wall (11; 12; 13) of the lid (4).

9. The pack (1) for smoking articles according to claim 1, wherein the sliding sleeve (20) has an open upper end and an open lower end opposite one another, a front wall (21) and a rear wall (22) parallel to and opposite one another, and two side walls (23) parallel to and opposite one another.

10. The pack (1) for smoking articles according to claim 1, wherein the sliding sleeve (20) has an open upper end and a lower wall (39) opposite one another, a front wall (21) and a rear wall (22) parallel to and opposite one another, and two side walls (23) parallel to and opposite one another.

11. The pack (1) for smoking articles according to claim 10, wherein the lower wall (39) of the sliding sleeve (20) has a through hole (40).

12. The pack (1) for smoking articles according to claim 1, wherein the locking system comprises a limit stop tab (26), which prevents the sliding sleeve (20) from being separated from the outer container (2), limiting the maximum sliding movement of the sliding sleeve (20) relative to the outer container (2).

13. The pack (1) for smoking articles according to claim 12, wherein the limit stop tab (26) comprises: an inner portion (27), which is glued to the rear wall (8) of the outer container (2); an outer portion (28), which is glued to a rear wall (22) of the sliding sleeve (20); and an intermediate portion (29), which connects the inner portion (27) to the outer portion (28) and is deformable.

* * * * *